US007174689B2

(12) United States Patent
Alyea et al.

(10) Patent No.: US 7,174,689 B2
(45) Date of Patent: Feb. 13, 2007

(54) CONCRETE ANCHOR FLOAT

(75) Inventors: Mark Duane Alyea, Rapid City, SD (US); Beth Marie Torpey, Rapid City, SD (US); Andrew Joseph Fisher, Borman, ND (US); Matthew Aaron Sletten, Rapid City, SD (US); Stephanie Nicole Pinon, Fort Collins, CO (US)

(73) Assignee: Building Construction Solutions, Inc., Rapid City, SD (US)

( * ) Notice: Subject to any disclaimer, the term of this patent is extended or adjusted under 35 U.S.C. 154(b) by 0 days.

(21) Appl. No.: 10/967,476

(22) Filed: Oct. 18, 2004

(65) Prior Publication Data

US 2005/0120666 A1 Jun. 9, 2005

Related U.S. Application Data

(60) Provisional application No. 60/527,671, filed on Dec. 5, 2003.

(51) Int. Cl.
*E04B 1/18* (2006.01)

(52) U.S. Cl. ..... 52/700; 52/633; 52/701; 52/708; 52/301

(58) Field of Classification Search ..... 52/700, 52/701, 708, 301, 296, 705, 633; 256/65.14
See application file for complete search history.

(56) References Cited

U.S. PATENT DOCUMENTS 2,366,401 A 1/1945 Haskell
2,823,539 A * 2/1958 Kersh et al. ..... 52/678
3,284,973 A * 11/1966 Ames et al. ..... 52/155
3,500,607 A 3/1970 Wilson
3,552,734 A 1/1971 Severino et al.
3,671,738 A * 6/1972 Beachley ..... 362/431
4,079,559 A * 3/1978 Tenbrummeler ..... 52/295
4,269,010 A * 5/1981 Glass ..... 52/154
4,614,070 A * 9/1986 Idland ..... 52/296
4,736,554 A * 4/1988 Tyler ..... 52/105
4,899,771 A * 2/1990 Wilkinson ..... 135/77
4,932,818 A 6/1990 Garwood
5,050,364 A * 9/1991 Johnson et al. ..... 52/705
5,060,436 A 10/1991 Delgado, Jr.
5,568,708 A * 10/1996 Kassardjian et al. ..... 52/301
5,934,821 A * 8/1999 Shaw et al. ..... 404/62
6,015,138 A * 1/2000 Kohlberger et al. ..... 256/65.14

(Continued)

*Primary Examiner*—Basil Katcheves
(74) *Attorney, Agent, or Firm*—Mark J. Spolyar

(57) ABSTRACT

A concrete anchor float that, in one embodiment, facilitates the placement of anchor bolts that protrude from concrete constructions, such as foundations. The concrete anchor float of the present invention can be used with nearly any conventional anchor bolt to insure the correct placement and alignment of the anchor bolt and to promote a strong bond between the anchor bolt and the concrete. According to an embodiment of the present invention, the concrete anchor float generally comprises a base plate with a hole, and a cap extending from the base plate over the hole. The cap includes a cavity configured to releasably secure the anchor bolt, and a top against which the anchor bolt rests upon insertion. According to an implementation of the present invention, the base plate includes features that minimize voids and air pockets between the anchor bolt and the concrete to promote a strong bond. In other implementations, the concrete anchor float includes an impalement protection surface that prevents serious injury that may otherwise result from falling on the anchor float.

9 Claims, 8 Drawing Sheets

U.S. PATENT DOCUMENTS 6,047,515 A 4/2000 Behlen
6,347,916 B1 2/2002 Ramirez
6,431,517 B1 8/2002 Chapman
6,449,919 B1 * 9/2002 Behlen ..... 52/699

* cited by examiner

CONCRETE ANCHOR FLOAT

CROSS-REFERENCE TO RELATED APPLICATIONS

The present application claims priority from U.S. provisional patent application Ser. No. 60/527,671 filed Dec. 5, 2003, and entitled "Concrete Anchor Float."

FIELD OF THE INVENTION

The present invention relates to concrete construction and, more particularly, to a concrete anchor float facilitating placement and alignment of anchor bolts in concrete foundations and other constructions.

BACKGROUND OF THE INVENTION

In the United States and throughout the world, anchor bolts are the primary means of securing building structures to concrete foundations. Indeed, most building codes have detailed requirements for such anchor bolts and their placement in concrete constructions. For example, according to some building codes, these anchor bolts must be made of half-inch, L-or J-shaped steel rods, and embedded into the concrete at least six inches deep. In many cases, the structure placed atop the concrete foundation is anchored by securing a sole plate to the anchor bolts. Sole plates are typically 2×4's or 2×6's with holes drilled for placement of the anchor bolts substantially down the center line of the sole plates. The anchor bolts protrude above the concrete far enough to pass through the holes in the sole plate and allow the use of a washer and nut to secure the sole plate to the foundation. Anchor bolts are also used in other contexts. In other applications, builders place anchor bolts, having the same placement and alignment requirements, to affix the base plate of a column or post to a concrete foundation or pad. That is, rather than securing a sole plate near the edge of the foundation, a plurality of anchor bolts, often in a geometric pattern, are used to secure the base plate of a column to a concrete pad.

Ideally, the anchor bolts extend vertically from the foundation, and are placed at the appropriate distance from the edge of the foundation such that they pass through holes in the center line of the sole plate. If the anchor bolts are not vertical or are not aligned properly, they create alignment problems, forcing the holes in the sole plate to be off of the center line. This circumstance may cause the sole plate and the connection to the foundation to be weakened, detrimentally affecting the integrity of the structure. In addition, if an anchor bolt protrudes too far above the sole plate, the anchor bolt is probably not embedded deeply enough in the concrete, which may also compromise the ability of nut to secure the sole plate to the foundation due to thread run out on the bolt shaft. Furthermore, if the anchor bolt does not protrude far enough, the builder will have to chisel or auger a large portion of the sole plate out to create a large cupped-out area with potentially multiple drill holes to correctly locate the low bolt to attach the washer and nut.

To erect a concrete foundation, most often, forms are set; and wet concrete is placed in the forms. The concrete is then "skreeded" to the appropriate grade or elevation. Sometime after the concrete is skreeded and before it cures, anchor bolts are inserted into the still pliable concrete. If the concrete is too wet, the anchor bolts have a tendency to sink or to tilt away from vertical. If the concrete is too hard, placing the anchor bolts tends to create dimples or funnel-shaped depressions (or air pockets) around the anchor bolts. These depressions and resultant stress frequently result in cracks, and a poor bond between the concrete and anchor bold. In addition, placement of anchor bolts in this manner often results in the anchor bolts being either too close or too far from the edge of the foundation, creating alignment problems for attachment of the sole plate. Another problem relating to placement of anchor bolts in this manner is possible damage to the threads of the anchor bolt after placement in the concrete, or the possibility of concrete becoming embedded in the threads.

The circumstances discussed above are not just theoretical possibilities or abstract problems. The applicants inspected 1,450 anchor bolts prior to attachment of sole plates on over thirty different building sites. These anchor bolts had been placed by a number of different contractors. Of the anchor bolts inspected, 55% had dimples (depressions around the anchor bolts between ⅛" and ⅜" deep), and 25% had air pockets (depressions around the anchor bolts between ⅜" and 5" deep). Of the anchor bolts which had dimples or air pockets, 70% showed at least minor cracking around the anchor bolts and 25% had severe cracking, including all of the anchor bolts which showed air pockets. According to the American Concrete Institute moderate to severe cracks around anchor bolts should be repaired by addition of gravity fed epoxy and drilling holes for remedial anchor bolts.

Laboratory tests were performed on a number of anchor bolts placed in concrete. A variety of strength tests were performed on anchor bolts which showed no dimples or air pockets and upon anchor bolts which showed dimples, air pockets of the less severe variety, and moderate cracking. The tests were performed under International Building Code standards and included the following: 1) concrete breakout strength of anchor bolts in tension [IBC 1913.4.2 & 1913.5.2], 2) pullout strength of anchor bolts in tension [IBC 1913.4.2 & 1913.5.3], 3) concrete side-face blowout strength of anchor bolts in tension [IBC 1913.4.2 & 1913.5.4], and 4) concrete pry-out strength of anchor bolts in shear [IBC 1913.4.2 & 1913.6.3]. The test results showed that anchor bolts with dimples, air pockets of the less severe variety, and moderate cracking were 38% to 50% weaker than anchor bolts without such conditions.

Several attempts have been made to solve at least some of the above described problems associated with the placement of anchor bolts in concrete. U.S. Pat. No. 4,932,818 issued to Garwood, for example, discloses a positioning mechanism, including a threaded plastic sleeve and an opposing flange member that holds an anchor bolt in the hole of a forming template. After concrete is poured, the forming template, including the anchor bolts secured by the positioning system, is placed on top of the curing concrete. U.S. Pat. No. 6,347,916 issued to Ramirez discloses a plastic cap which fits over the treaded end of an anchor bolt. The cap has a disk-shaped base which "floats" on top of the concrete, helping to ensure that the anchor bolt projects the appropriate distance above the concrete and remains vertical. After the concrete is cured, the top portion of the cap is removed, leaving the disk-shaped base in the foundation. Even if an anchor bolt is correctly placed in the concrete, the very act of placement may cause air pockets or dimples around the anchor bolt. As discussed above, such air pockets or dimples weaken the bond between the anchor bolt and the concrete (as set out above) and should be avoided.

Anchor bolts, after placement in a concrete foundation, also raise safety issues. Indeed, there is growing concern within the building industry, and among building construction safety regulators, relating to the possibility of impalement or other injuries caused by protruding steel, such as anchor bolts. For example, the Occupational Safety and Health Administration (OSHA) has promulgated regulations relating to protruding steel at construction sites. Although OSHA regulations do not specifically identify anchor bolts as a potential hazard, there is obviously a possibility that workers, or even trespassers, on the building site could be injured by falling on an anchor bolt which may protrude 2" to 4" from the foundation.

In light of the foregoing, a need in the art exists for methods, apparatuses and systems that address the problems discussed above. For example, a need in the art exists for a concrete anchor float that reduces voids and air pockets which may form around anchor bolts, thereby promoting a stronger bond between the anchor bolt and the concrete. A need also exists in the art for methods, apparatuses and systems that help protect against injuries caused by falling on anchor bolts. Embodiments of the present invention substantially fulfill these needs.

SUMMARY OF THE INVENTION

The present invention provides a concrete anchor float that, in one embodiment, facilitates the placement of anchor bolts that protrude from concrete constructions, such as foundations or footings for support posts. The concrete anchor float of the present invention can be used with nearly any conventional anchor bolt to insure the correct placement and alignment of the anchor bolt and to promote a strong bond between the anchor bolt and the concrete. According to an embodiment of the present invention, the concrete anchor float generally comprises a base plate with a hole, and a cap extending from the base plate over the hole. The cap includes a cavity configured to releasably secure the anchor bolt, and a top against which the anchor bolt rests upon insertion. According to an implementation of the present invention, the base plate includes features that minimize voids and air pockets between the anchor bolt and the concrete to promote a strong bond. In other implementations, the concrete anchor float includes an impalement protection surface that prevents serious injury that may otherwise result from falling on the anchor float.

DESCRIPTION OF PREFERRED EMBODIMENT(S)

Figure 1:
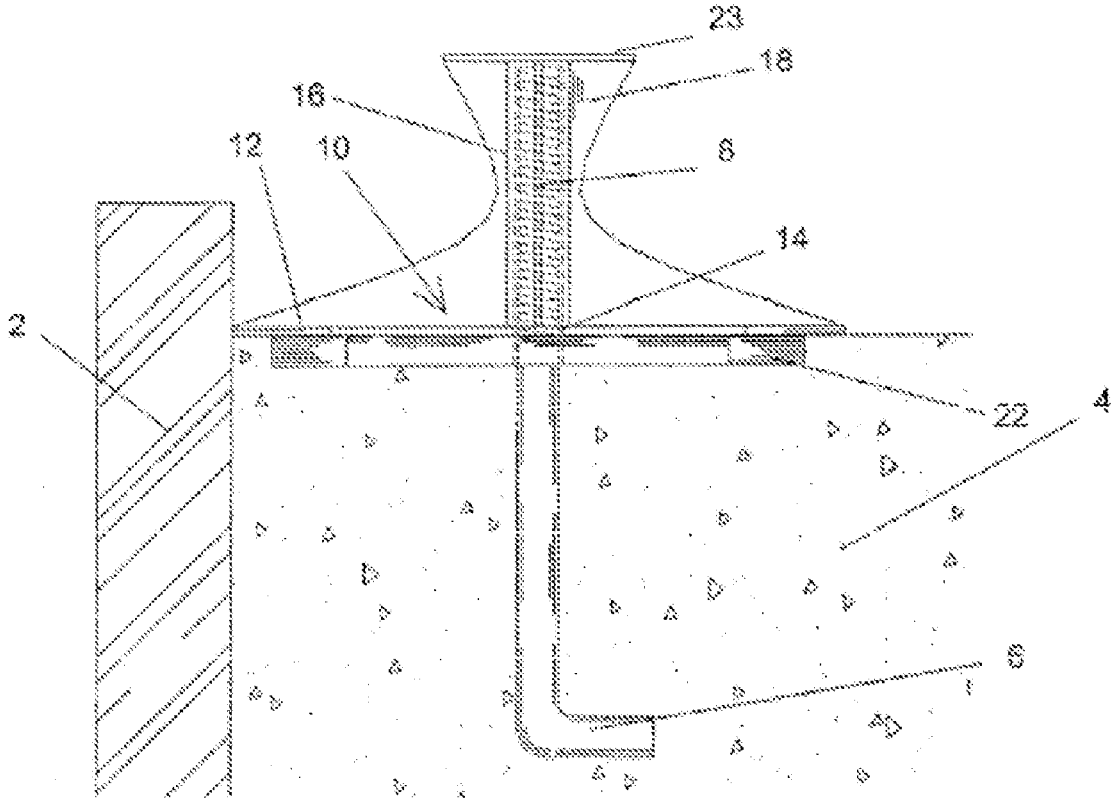
FIG. 1 is a sectional plan view of a concrete anchor float according to an embodiment of the present invention.
Figure 2:
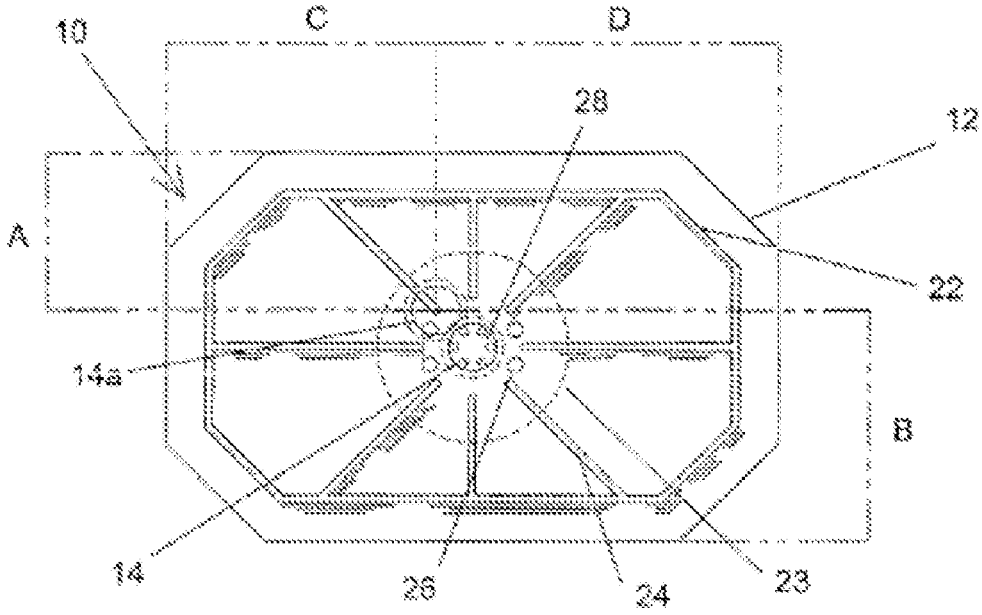
FIG. 2 is a bottom view of the concrete anchor float according to an embodiment of the present invention.
Figure 3:
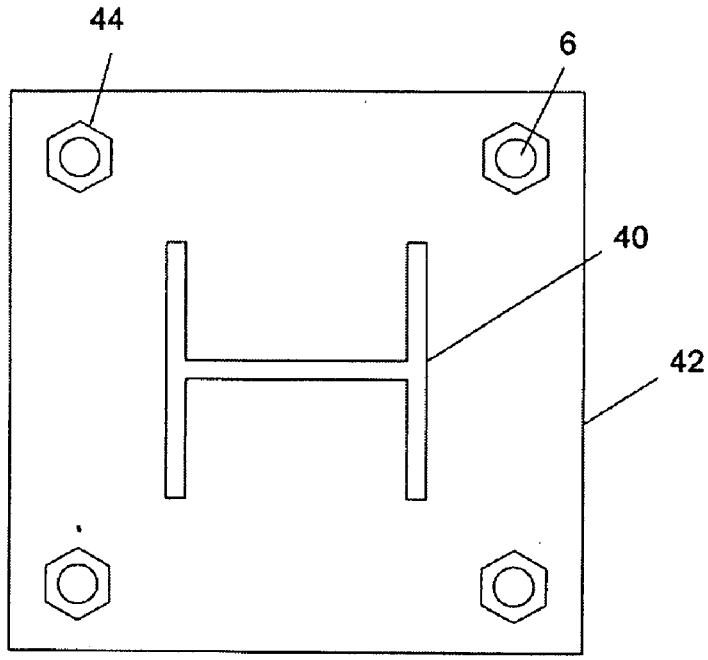
FIG. 3 is a top plan view of a typical installation of a column or post on a concrete pad.
Figure 4:
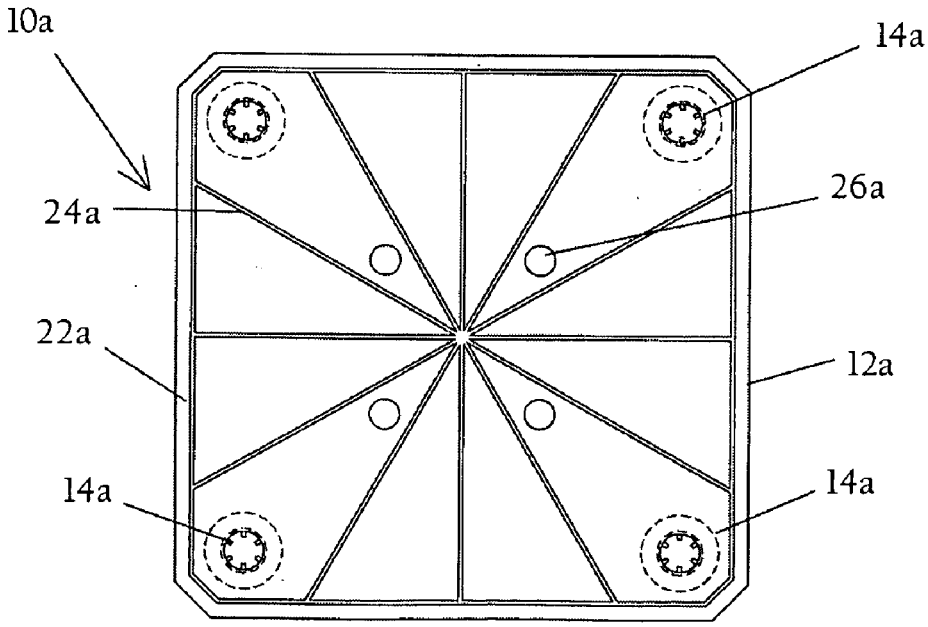
FIG. 4 is a concrete anchor float, according to a second embodiment of the present invention, facilitating the placement of anchor bolts for a column base plate.

Referring to the drawings, FIGS. 1 and 2 illustrate the concrete anchor float according to an embodiment of the present invention, The concrete anchor float can be configured to be used with any number of conventional anchor bolts, and can be implemented in a variety of size configurations. In one embodiment described below the concrete anchor float is configured to operate in connection with a single anchor bolt that is ½ in diameter. In other implementations, the present invention can be configured to operate in connection with rebar, or any other rod-shaped member. FIGS. 3 and 4 disclose a second embodiment of the concrete anchor float adapted for the placement of multiple anchor bolts in a pattern for installation of a column or post.

Figure 5:
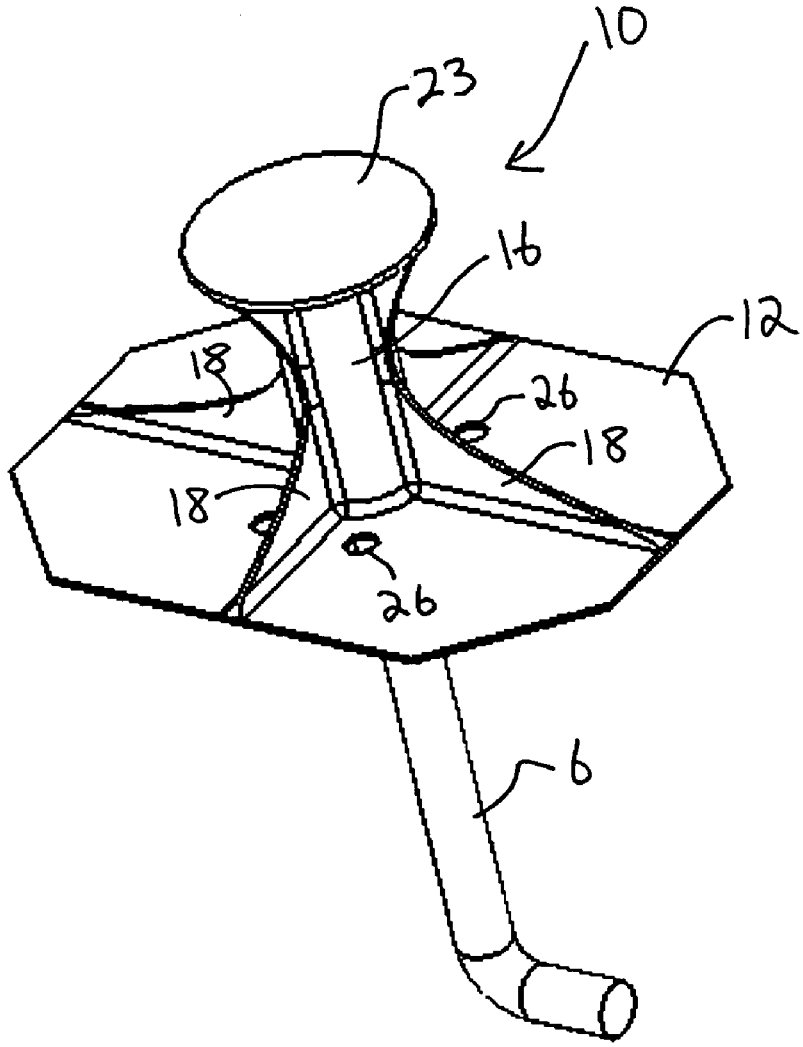
FIG. 5 is a perspective view of the concrete anchor float according to an embodiment of the present invention.
Figure 6:
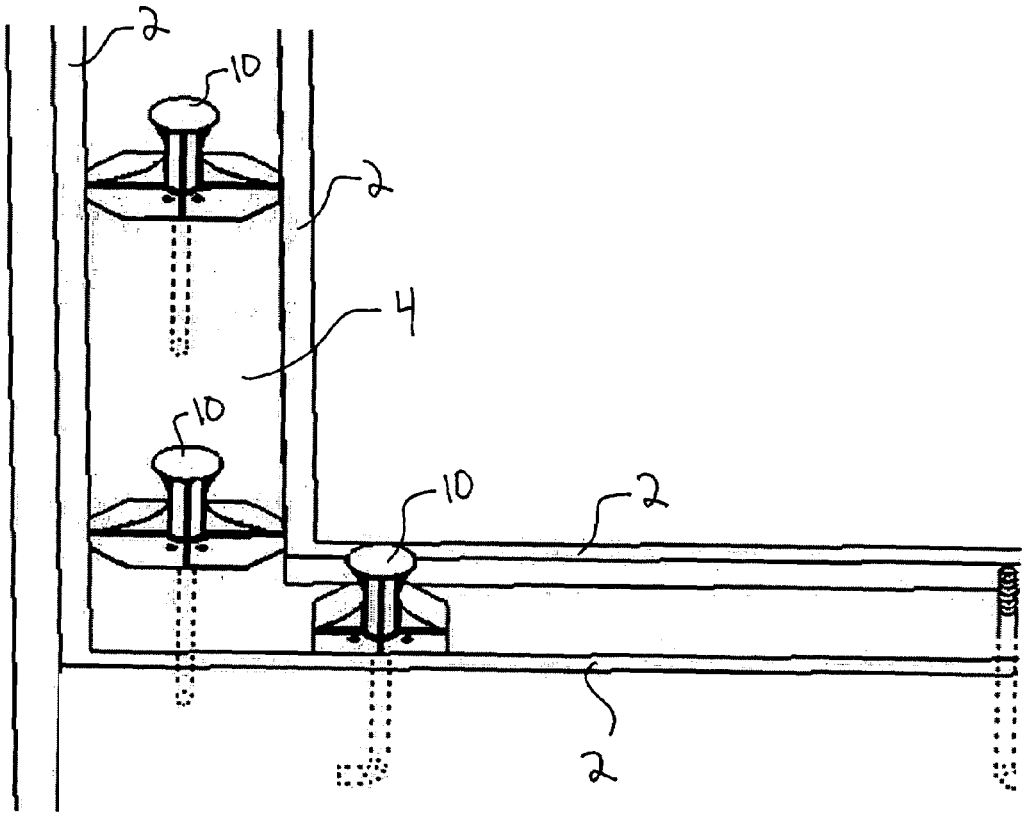
FIG. 6 is a perspective view of the concrete anchor float, according to an embodiment of the present invention, as used in connection with a concrete form construction.

Now referring to FIGS. 1 and 5, a side and perspective view, respectively, of the concrete anchor float 10 is shown as it might be used in the construction of a typical concrete foundation. As FIGS. 1 and 6 illustrate, in most cases, a series of concrete forms 2 are placed in appropriate locations to contain and shape the concrete 4 as desired. An anchor bolt 6 is inserted into the concrete 4 before it hardens. In FIG. 1, the anchor bolt 6 shown has an L-shape; however, anchor bolt 6 may feature other shapes, such as a J-shape. The threaded end 8 of the anchor bolt 6 protrudes above the surface of the concrete 4 by a desired amount. According to conventional concrete construction methods, after the concrete 4 hardens, a hole is drilled through a sole plate (not shown) and the sole plate is secured to the threaded end 8 of the anchor bolt 6 using a washer and nut (not shown). As FIG. 1 illustrates, the concrete anchor float 10, according to embodiments of the present invention, can be used to insure that the anchor bolt 6 (1) is placed at the appropriate distance from the outside edge of the concrete 4, (2) is vertical, (3) has its threads protected, (4) and/or forms a secure bond with the concrete 4.

Still referring to FIG. 1, the concrete anchor float 10 includes a base plate 12 which, in one implementation, is generally rectangular with tapered edges, and a cap 16 including a generally cylindrical cavity therein that is configured to releasably secure an anchor bolt 6 therein. In a preferred embodiment, the concrete anchor float 10 is an injection-molded device, made of plastic (such as high density polyethylene (HDPE)). However, other materials having sufficient resistance to weather and concrete, strength, and flexibility could also be used.

As FIG. 2 illustrates, the base plate 12, in one embodiment, includes hole 14 substantially through the center of the base plate 12. Hole 14 has a diameter larger than the diameter of anchor bolt 6 to allow it to be inserted therein. Concrete anchor float 10 also includes cavity cap 16 extending perpendicularly from base plate 12. The cylindrical cavity in cavity cap 16 is generally centered on hole 14 of base plate 12. As FIGS. 1 and 5 illustrate, cavity cap 16 has a generally cylindrical shape, and includes cap 23 that defines an impalement protection surface. As FIGS. 1 and 2 show, the cavity cap 16 is open on its bottom and closed on top. The inside diameter of the cavity cap 16 (i.e., the diameter of the cavity) is larger than the diameter of the anchor bolt 6. In one implementation, the diameter of the cavity cap 16 is substantially the same as the diameter of hole 14. In one embodiment, the distance from the top of the base plate 12 to the underside of the top 23 of the cavity cap 16 allows the anchor bolt to be placed in the concrete 4 and protrude above the top surface of the concrete 4 at a desired distance. As one skilled in the art will recognize, varying this distance will also change the length of the anchor bolt 6 that extends from the concrete 4. Accordingly, this distance, in one embodiment, is configured to conform to general building or construction requirements. In one embodiment, the distance between the lower surface of top 23 and the base plate 12 is approximately 2.5 inches. Still further, cavity cap 16 can be integrally formed with base plate 12 as shown in FIG. 1. In other implementations, cavity cap 16 can be removed fmm the base plate as discussed more fully below in connection with a second illustrated embodiment of the present invention.

Figure 7:
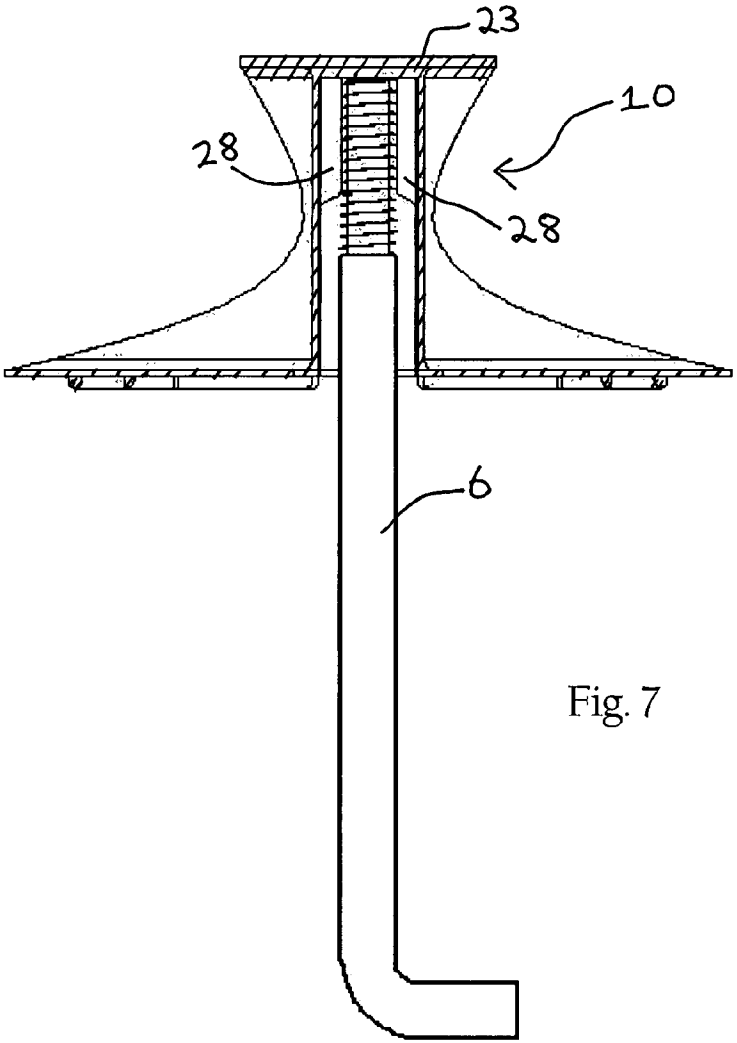
FIG. 7 is a sectional view of the concrete anchor float according to an embodiment of the present invention.

A variety of mechanisms can be used to releasably secure the anchor bolt 6 within the cavity of cavity cap 16. As FIG. 2 illustrates, the inner surface of cavity cap 16, in one implementation, further includes a plurality of tabs or fins 28 that are configured to releasably secure anchor bolt 6 as shown in figures 1 and 7. In one implementation, tabs 28 act to hold the anchor bolt 6 in place within the concrete anchor float 10. In one embodiment tabs 28 are configured and sized such that they will accommodate anchor bolts having slightly different diameters and deform slightly to hold the anchor bolt 6 in place. In some implementations, insertion of the anchor bolt 6 into the cavity of cavity cap 16 will scrape off some material from tabs 28 to accommodate the anchor bolt. In other implementations, the tabs 28 will deform to accommodate the anchor bolt. The surface of tabs 28 that contact anchor bolt 6 can be generally flat, or include a saw-toothed configuration. Tabs 28, in one embodiment, are 0.055 inches wide and extend along the cavity in cavity cap 16 at a distance of approximately 15/8 inches. In one implementation, a first set of tabs can be configured to extend further toward the central axis of the concrete anchor float 10, while a second set of tabs can be recessed relative to the first set of tabs. In one implementation, the first and second set of tabs are arranged in an alternating or interleaved configuration. In such a configuration, the first set of tabs operate to contact and hold anchor bolt 6 in place, while the second set of tabs act as guides. For a ½-inch anchor bolt, for example and in one implementation, the bolt-contacting surfaces of the first set of tabs can be oriented at a diameter of 0.46 inches (relative to the axis of the cavity in cavity cap 16, while the outer surfaces of the second set of guiding tabs can be oriented along a diameter of 0.52 inches. In one implementation, tabs 28 can also be configured to taper off as then extend toward base plate 12 to facilitate insertion of the anchor bolt 6. Other implementations are also possible. For example, the cavity in cavity cap 16 need not include tabs 28. For example, the diameter of the cavity in cavity cap 16 can be configured to provide a "press fit" for a desired anchor bolt 6. Other means for releasably securing the anchor bolt 6 within the cavity include detents extending within the cavity in cavity cap 16 as disclosed in U.S. Pat. No. 3,552,734 (incorporated by reference herein).

As FIG. 5 shows, cap 23, in one embodiment, has a generally round, flat shape, and is centered upon and affixed to the top of the cavity cap 16. The cap 23 is of sufficient size, strength, and rigidity to help prevent injuries from violent contact and to comply with any relevant rules or regulations regarding impalement injuries. In one implementation, the diameter of cap 23 is 2.25 inches; of course, the cap 23 can be configured in a variety of sizes and dimensions. In one embodiment, cavity cap 16 also includes a plurality of stabilizers 18 affixed to the outer surface of the cavity cap 16, the under side of the cap 23, and the top surface of the base plate 12. In one embodiment, stabilizers 18 provide rigidity and support to cavity cap 16 and cap 23. The diameter of cap 23, in one embodiment, is substantially larger than anchor bolt 6 to provide a form of impalement protection. That is, the relative large surface protects a worker, or other person, from being impaled by the anchor bolt during a fail, for example. Although FIG. 5 shows the upper surface of top as being generally flat, cap 23 can be configured to have other surface contours, such as a generally rounded or domed configuration, a hemispherical configuration, and the like. The larger surface area of cap 23 also provides other benefits. For example, cap 23 provides a relatively large surface area against which a user can press to facilitate placement of the concrete anchor float and attached anchor bolt, as the user inserts the assembly into curing concrete (especially after the concrete has had some time to cure and has begun to harden).

As FIG. 2 shows, a ridge 22 protrudes downwardly from the bottom surface of the base plate 12, extending around hole 14. The ridge 22 extends around the perimeter of the base plate 12 at an inward offset from the perimeter. In a preferred embodiment, the ridge 22 is offset from the perimeter at a distance where the concrete between the outer edge of the foundation and the ridge 22 is sufficiently wide so as to structural integrity and avoid crumbling away. In one implementation, the ridge 22 is offset from the outer perimeter of base plate 12 at a distance of 0.75 inches. As F*igure* 2 also illustrates, base plate 12 further includes a plurality of ribs 24. The ribs 24, in one embodiment, generally extend from the ridge 22 at various points substantially in the direction of hole 14. In the implementation shown, the ribs 24 terminate at points approximately ⅛ to ¼ inches from the circumference defined by hole 14. In one embodiment, ridge 22 and ribs 24 protrude from base plate 12 at a distance between ⅛ to ¼ inches. Ridge 22 and ribs 24, In one embodiment, are also 1/8-inch thick. Of course, ridge 22 and ribs 24 can be configured in a variety of suitable dimensions. For example, ridge 22 and ribs 24 protrude from base plate 12 at the same distance; in other implementations, these distances can be varied such that the ridge 22 extends further from the base plate 12 than the ribs 24. As the base plate 12 is pressed against the curing concrete 4, the mortar in the concrete 4 is initially displaced by ridge 22 and ribs 24, initially forcing it out toward ridge 22 and then being channeled back by ribs 24 toward the anchor bolt 6 inserted in hole 14. This "screeding" effect helps to eliminate voids and air holes near anchor bolt 6, promoting a strong bond between anchor bolt 6 and concrete 4. In one implementation, the footprint of base plate 12, created in the cured concrete 4 by the configuration of the ridge 22 and ribs 24, can be configured for recognition purposes to allow inspectors to determine what product has been used. In addition, the concrete anchor float speeds up the placement process which also directly affects the bonding, cracking and air pocket issues, discussed above, by allowing more anchor bolts to be placed before substantial curing of the concrete has taken place.

Still further, as FIG. 2 shows, base plate 12 further includes vent holes 26. In the implementation shown vent holes 26 are ¼ in diameter and are located near hole 14 and the ends of ribs 24. In one preferred embodiment, vent holes are located proximally to hole 14 to allow for air to escape, and thereby reduce the potential for air pockets underneath base plate 12, as the base plate 12 is pressed against the surface of the concrete 4. Although the embodiment illustrated in FIG. 2 includes four vent holes 26, a variety of vent hole configurations can be employed in the present invention.

FIG. 2 also provides a view of the generally rectangular shape of base plate 12. In one implementation, the length and width of the base plate are configured to facilitate alignment of the anchor bolts within the concrete. The length of base plate 12 is, in one implementation, configured to conform to the width of a larger sole plate such as a 2×6, while the width is the width of a smaller typical sole plate such as a 2×4. The length and width of base plate 12 are configured such that when the width is aligned with the inner or outer edge of the foundation (against form 2), the anchor bolt will be placed the appropriate distance from the edge to center a 2×4 sole plate and; when the length is aligned with the edge of the foundation, the anchor bolt will be placed the appropriate distance from the edge to center a 2×6 sole plate.

As FIG. 2 also illustrates, hole 14 may be offset relative to the outer edges of base plate 12 to create additional alignment offset distances. For example, hole 14 may be offset toward one of the long edges and one of the short edges of the base plate 12. This offset position is shown as hole 14*a*. Cavity cap 16, as well as vent holes 26 and the ends of ribs 24, would also be displaced accordingly. This configuration creates four different distances from the center of the hole 14*a* to one of the four outer edges of the base plate 12. These distances are indicated by the phantom lines and labeled A, B, C, and D. In this embodiment, the concrete anchor float can be used to accommodate sole plates of four different widths rather than two. For example, distance A might accommodate a 2×2, distance B a 2×4, distance C a 2×6, and distance D a 2×8. For instance, with the top edge of the base plate 12 aligned with the edge of the concrete 4, an anchor bolt would be aligned with the center line of a 2×2. In one implementation, the base plate 12 can be configured to center anchor bolts for sole plates on interior walls that are typically poured with 6" foundations. Typically, the sole plate on interior walls Is centered leaving equal amounts of concrete on both sides of the sole plate. Unlike foundation walls where the outside edge of the foundation wall is the usual reference edge. In one implementation, the distance between the diagonally opposed edges 29 is configured to center the anchor bolt between wall forms spaced apart at six inches.

In use, the anchor bolt 6 is inserted in hole 14 and pressed into the cavity of cap 16 such that the end of the anchor bolt 6 rests against the inner surface of cap 23. After the concrete 4 has been placed but before it has substantially cured, the anchor bolt 6 is inserted into the concrete 4. To effect insertion of the anchor bolt 6 into the concrete, a user generally grasps the end of cavity cap 16 with the palm of one hand resting on the outer surface of cap 23 and pushes the anchor bolt 6 into the concrete. Insertion of the anchor bolt 6 may also require a jiggling or other action to displace aggregate in the concrete that lies in the insertion path of the anchor bolt 6. It is generally up to the user to ensure that the base plate 12 rests properly against the top surface of the concrete. The concrete anchor float 10 allows insertion of the anchor bolt 6 at various stages of the concrete cure process. For example, if the concrete has been recently poured and is still very wet, the base plate 12 allows the anchor bolt 6 to float in its desired position as the concrete cures. If the concrete 4 has been allowed to dry for a length of time, the cap 23 facilitates insertion of the anchor bolt by distributing the pressure placed on the user's hand across the top surface as the user inserts the anchor bolt into the hardening concrete 4. In either case, because of the height of the cavity cap 16, the appropriate length of the anchor bolt 6 protrudes above the top surface of the concrete 4. In some implementations, one of the edges of the base plate 12 is aligned with the edge of the concrete 4, as discussed above, such that the anchor bolt 6 is properly aligned with the desired center line location of a sole plate.

After the concrete 4 has begun to set, the base plate 12 can be worked into the concrete with, for example, a trowel when the workers smooth off or finish the top surface of the concrete 4. In one implementation, this can be accomplished by running the trowel over the base plate 12 such that the upper surface of the base plate is flush with the finish of the concrete 4. As discussed above, however, the user may simply grasp cap 23 and move (e.g., jiggle) the concrete anchor float from side to side during the initial insertion of the anchor bolt to effect a screeding action. As the ridge 22 and ribs 24 contact the concrete 4, they act upon the mortar in the concrete to force it inwardly toward the anchor bolt 6. This action helps to ensure that there are no voids or air pockets in the concrete 4 around the anchor bolt 6, promoting a strong bond between the anchor bolt 6 and the concrete 4. The vent holes 26 allow air and, possibly, liquid to escape from the underside of the base plate 12, facilitating the escape of air and thus the removal of air pockets.

In general use, concrete anchor float 10 remains disposed over the anchor bolt 6 until it is time to install the sole plate. In this manner, concrete anchor float 10 protects the threaded end 8, and helps to prevent impact or impalement injuries from violent contact with the anchor bolt 6. After the concrete 4 has set and just prior to the installation of the sole plate, the operator may grasp the cap 23 and pull the entire concrete anchor float 10, including base plate 12, away from the anchor bolt 6 and concrete 4.

A variety of embodiments according to the present invention are possible. For example, referring to FIG. 3, a typical installation of a column or post on a concrete pad is shown. Typically, an I-beam 40 (or similar structural element) is welded to a column base plate 42. Holes in the column base plate 42 correspond to the placement of the anchor bolts 6. A plurality of anchor bolts 6 are inserted into a concrete pad (not shown) in an appropriate pattern corresponding to the column base plate 42. The column base plate 42 is placed over the anchor bolts 6, and the column base plate 42 secured to the anchor bolts 6 by a plurality of nuts 44.

Figure 8:
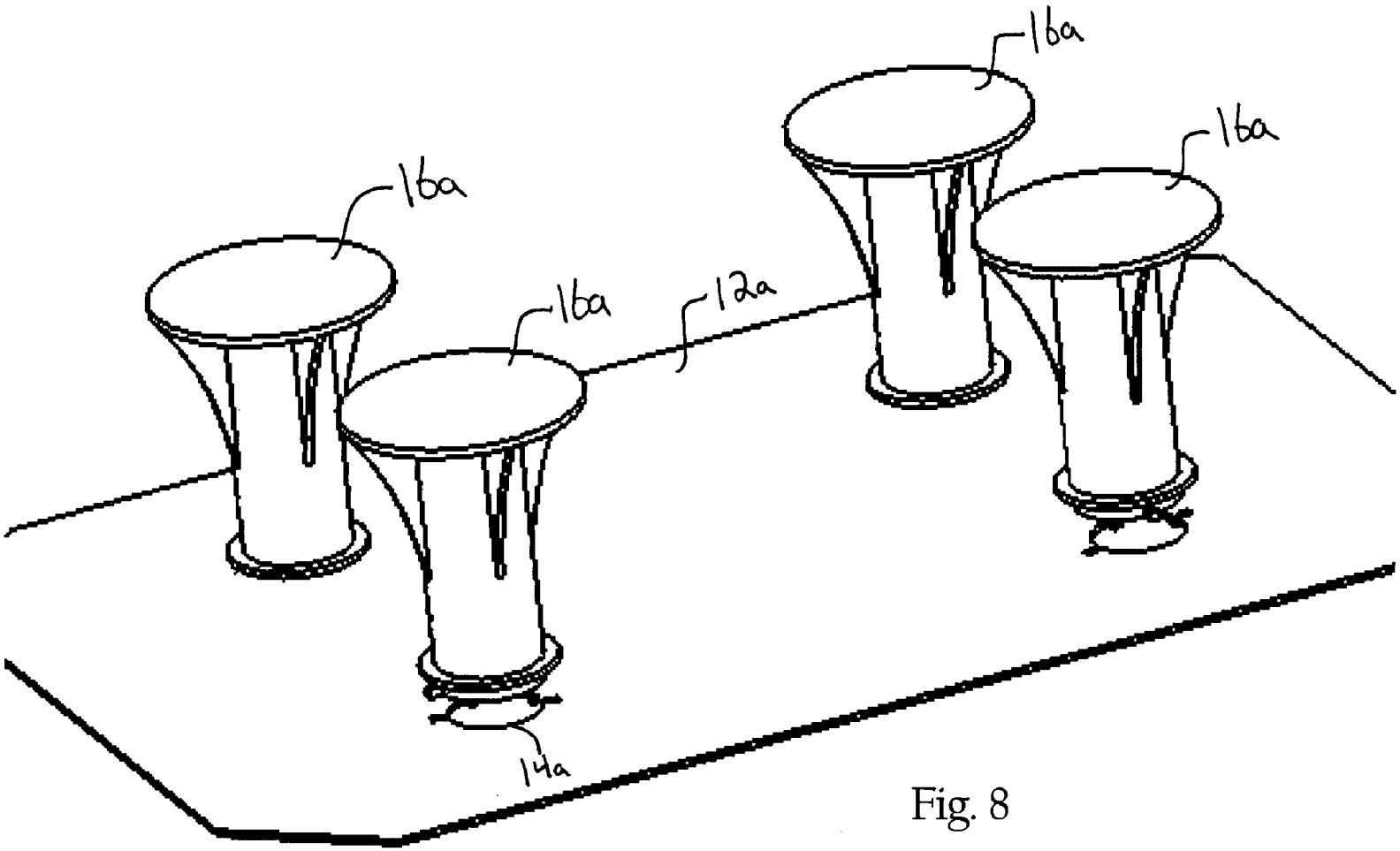
FIG. 8 is a perspective view of the concrete anchor float according to the second embodiment of the present invention.
Figure 9:
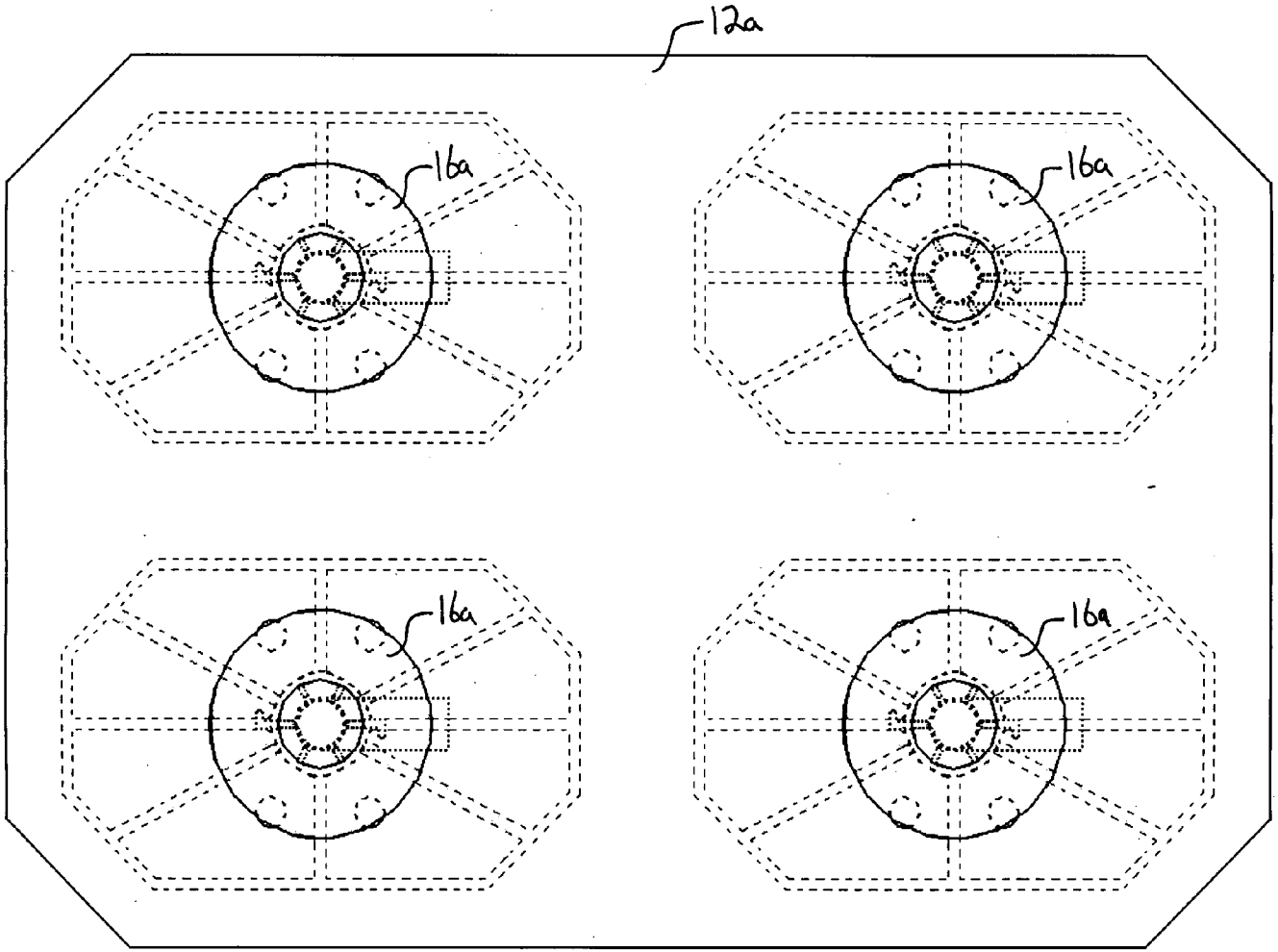
FIG. 9 is a top plan view of the concrete anchor float according the second embodiment of the present invention.
Figure 10:
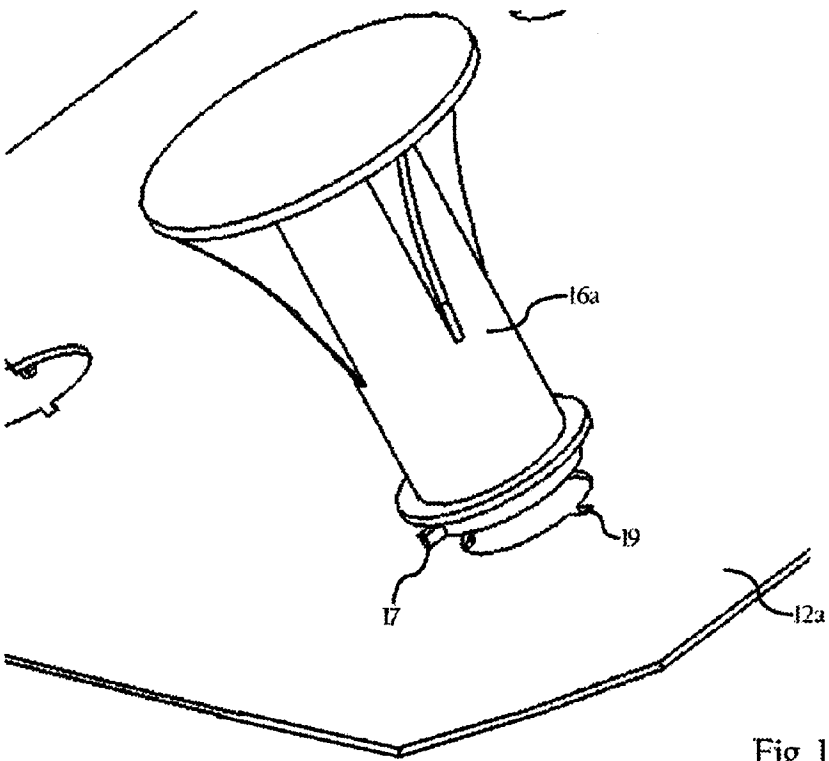
FIG. 10 is a perspective view illustrating the attachment mechanism between the base plate and cap of the concrete anchor float according to the second embodiment of the present invention.

FIG. 4 illustrates the base plate 12*a* of concrete anchor float 10*a*, according to another embodiment of the present invention, which is adapted to facilitating placement of anchor bolts 6 for use with column base plate 42. As FIGS. 1 and 8 illustrate, the concrete anchor float 10*a* features a different arrangement of the same basic elements as described above. For example, rather than having a particular length and width to position a single anchor bolt, the concrete anchor float 10*a* includes a base plate 12*a* having the same general size and shape as the concrete pad or column base plate 42. The concrete anchor float 10*a* further includes four caps 16*a* (and associated elements) extending from holes 14*a* and arrayed in the appropriate pattern corresponding to column base plate 42. Furthermore, as FIG. 4 illustrates, ribs 24*a* extend radially outward from the center of base plate 12*a* to ridge 22*a*. Vent holes 26*a* are located at least in the regions defined by ribs 24*a* that include holes 14*a*. However, as FIG. 9 illustrates, the base plate 12*a* may also include sets of ridges 22*a* and ribs 24*a* corresponding to each cap 16*a*. Still further, as FIG. 10 illustrates, cap 16*a* may be releasably attachable to the base plate 12*a*. In one implementation, cap 16*a* includes key 17, while hole 14*a* includes a corresponding slot 19. In use, a user may place base plate 12*a* in contact with the curing concrete, and then separately insert anchor bolts, over which caps 16*a* have been placed, through holes 14*a* into the concrete. To lock the caps 16*a* in place, the user inserts key 17 into slot 19, and twists cap 16*a*. In addition, the user may assemble the caps 16*a* onto base plate 12*a* before inserting the anchor bolts into the curing concrete. Still further, other releasable attachment mechanisms can be used, such as detent or snap-fit mechanisms. Otherwise, the use and operation of this embodiment of the concrete anchor float 10*a* is substantially the same as described above.

While preferred embodiments of this invention have been shown and described above, it will be apparent to those skilled in the art that various modifications may be made in these embodiments without departing from the spirit and scope of the present invention. For example, variations of the dimensions of various elements describe above are contemplated and fall within the scope of the present invention. Other embodiments of the present invention will be apparent to one of ordinary skill in the art. It is, therefore, intended that the claims set forth below not be limited to the embodiments described above.

What is claimed is:

1. An anchor float, comprising a cavity cap Including a substantially cylindrical cavity configured to releasably secure an anchor bolt therein;

a base plate attached to the cavity cap, and including a hole in substantial alignment with the substantially cylindrical cavity;

a ridge protruding from the base plate and extending around the first hole and wherein the ridge protrudes from a bottom surface of the base plate; and a plurality of ribs extending inwardly from the ridge substantially in the direction of the first hole; wherein the cavity cap includes a cavity therein and a plurality of tabs extending along the cavity to releasably secure an anchor bolt within the cavity; and wherein a first set of tabs in the plurality of tabs extend a first distance into the cavity, and wherein a second set of tabs in the plurality of tabs extend a second distance into the cavity, wherein the first distance is greater than the second distance.

2. The anchor float of claim 1 wherein the ridge extends around the base plate at a substantially uniform distance from the perimeter of the base plate.

3. The anchor float of claim 1 wherein the base plate further comprises at least one vent hole.

4. The anchor float of claim 3 wherein the at least one vent hole is located proximally to the first hole.

5. The anchor float of claim 1 wherein the plurality of ribs each terminate proximal to the edge of the first hole.

6. The anchor float of claim 1 wherein the plurality of tabs are tapered toward the ends thereof proximal to the first hole.

7. The anchor float of claim 1 wherein the tabs of the first and second sets are arranged in an interleaved configuration.

8. The anchor float of claim 1 wherein the first distance is configured to releasably secure an anchor bolt in the cavity, while the second distance is configured to guide the anchor bolt during insertion into the cavity.

9. The anchor float of claim 1 wherein the cap is releasably attached to the base plate.

* * * * *